US012398924B1

(12) United States Patent
Bolton

(10) Patent No.: US 12,398,924 B1
(45) Date of Patent: Aug. 26, 2025

(54) MODULAR REVERSIBLE WATER HEATER DESIGN

(71) Applicant: John Darcy Bolton, Irvine, CA (US)

(72) Inventor: John Darcy Bolton, Irvine, CA (US)

( * ) Notice: Subject to any disclaimer, the term of this patent is extended or adjusted under 35 U.S.C. 154(b) by 0 days.

(21) Appl. No.: 18/238,273

(22) Filed: Aug. 25, 2023

(51) Int. Cl.

| | |
|---|---|
| ***F24H 9/14*** | (2006.01) |
| ***F24H 1/18*** | (2022.01) |
| *F24H 9/40* | (2022.01) |
| *F24H 9/45* | (2022.01) |

(52) U.S. Cl.
CPC ..... *F24H 9/148* (2013.01); *F24H 1/183* (2013.01); *F24H 1/181* (2013.01); *F24H 9/14* (2013.01); *F24H 9/40* (2022.01); *F24H 9/455* (2022.01)

(58) Field of Classification Search
CPC . F24H 9/148; F24H 9/183; F24H 9/14; F24H 9/40; F24H 9/455; F24H 1/181
USPC ..... 122/13.01
See application file for complete search history.

(56) References Cited

U.S. PATENT DOCUMENTS

| | | | | |
|---|---|---|---|---|
| 2,616,023 | A * | 10/1952 | Meyer | F22B 1/287 219/494 |
| 2,718,583 | A | 9/1955 | Noland et al. | |
| 2,834,865 | A | 5/1958 | Coates | |
| 3,358,118 | A | 12/1967 | Mather et al. | |
| 4,499,030 | A * | 2/1985 | Stewart | F24F 6/04 261/106 |
| 4,865,014 | A | 9/1989 | Nelson | |
| 7,255,245 | B2 | 8/2007 | Oliveira et al. | |
| 7,699,188 | B2 | 4/2010 | Oliveira et al. | |
| 7,810,670 | B2 | 10/2010 | Carter et al. | |
| 8,869,399 | B2 | 10/2014 | Lesage et al. | |
| 9,303,896 | B2 | 4/2016 | Lesage et al. | |
| 9,435,566 | B2 | 9/2016 | Hill et al. | |
| 10,030,915 | B2 | 7/2018 | Alessandrini | |
| 11,402,126 | B1 | 8/2022 | Riblet et al. | |
| 2007/0186872 | A1* | 8/2007 | Shellenberger | F23G 7/07 122/4 D |
| 2009/0178629 | A1 | 7/2009 | Rckwell | |
| 2019/0170394 | A1* | 6/2019 | Kuo | F24H 9/148 |

FOREIGN PATENT DOCUMENTS

| | | |
|---|---|---|
| CA | 2759310 | 1/2016 |

* cited by examiner

*Primary Examiner* — Steven B McAllister
*Assistant Examiner* — Benjamin W Johnson
(74) *Attorney, Agent, or Firm* — Gugliotta & Gugliotta LPA

(57) ABSTRACT

A modular water heater tank design is provided that enhances the longevity and efficiency of domestic hot water heaters. Interchangeable upper and lower pans allow the water tank to be inverted after several years of continuous use. By repositioning the pans, the thermal stress and temperature gradients experienced by the tank are significantly reduced, thereby extending its operational life. Additionally, the salt precipitation within the tank is removed from new lower pan, ensuring improved heat absorption and preventing premature corrosion.

4 Claims, 2 Drawing Sheets

MODULAR REVERSIBLE WATER HEATER DESIGN

RELATED APPLICATIONS

There are no previously filed, nor currently any co-pending applications, anywhere in the world.

BACKGROUND OF THE INVENTION

1. Field of the Invention

The present invention relates generally to a hot water heaters for domestic use and, more particularly, to a modularly constructed hot water heater that allows for increased effective life.

2. Description of the Related Art

A hot water heater, also known as a water heater or geyser, is a common appliance used to heat and store water for various purposes such as domestic use, bathing, and space heating. A domestic hot water heater consists of a relatively large tank made of steel, usually about ⅛ of an inch thick. Attached to the bottom holds a mechanism for generating heat, whether by electric heat or a gas flame. There are some chimneys running through the tank that act as heat exchanger between the got gasses and the water in the tank. There is a second pan on the top of the tank that conducts the products of combustion away from the tank and into pipes to carry the fumes to discharge outside of the dwelling.

While different types of hot water heaters exist, as shown in conjunction with FIG. 1 the following are typical components and construction of a typical residential storage tank water heater according to the PRIOR ART.

Heating Element/Burner. The heating element or burner 10 is responsible for heating the water in the tank 22. In an electric water heater, one or two electric heating elements, similar to large coils, are immersed in the water. These elements heat up when electricity passes through them. In a gas water heater, a gas burner is located at the bottom of the tank, which ignites and heats the water when gas is supplied.

Thermostat. The thermostat 12 is a temperature control device that regulates the water temperature in the tank. It is usually located on the outside of the tank and allows the user to set the desired temperature. When the temperature drops below the set point, the thermostat signals the heating element or burner to activate and heat the water until the desired temperature is reached.

Dip Tube. The dip tube 14 is a plastic or copper tube that delivers cold water from the incoming water supply to the bottom of the tank. This ensures that cold water is introduced at the bottom, while hot water remains at the top, ready for use. It prevents the incoming cold water from mixing directly with the hot water near the outlet.

Pressure Relief Valve. The pressure relief valve 16 is a safety device designed to prevent excessive pressure buildup inside the tank. It is typically located on the side or top of the tank. If the pressure or temperature inside the tank exceeds a certain limit, the valve automatically opens to release the excess pressure and protect the tank from potential damage.

Drain Valve. The drain valve 18 is located at the bottom of the tank and allows for easy draining of the water heater when maintenance or repairs are required. It is typically a simple faucet-like valve that can be opened to drain the water from the tank.

Anode Rod. The anode rod, also known as a sacrificial anode 20, is a metal rod typically made of aluminum or magnesium that is suspended inside the tank. Its purpose is to attract and corrode more readily than the steel tank, thus protecting the tank from rust and corrosion. Over time, the anode rod may need to be replaced to ensure the longevity of the water heater.

Tank. The tank 22 is a cylindrical or rectangular container made of steel or other durable materials. It is designed to store and hold a certain amount of water, typically ranging from 20 to 80 gallons (75 to 300 liters). The tank 22 is also generally insulated to minimize heat loss and maintain the temperature of the stored water. The tank is enclosed to provide a pressure-resistant water storage tank. In the center of the tank is a hollow exhaust flue through which exhaust gases from the burner flow up to an exhaust vent. In most designs, a spiral metal baffle 24 inside the flue captures heat from the exhaust gases and transmits it to the surrounding tank.

The tank is often constructed using steel with a glass lining or a glass-lined steel tank. This combination provides durability and corrosion resistance. The steel tank provides strength and structural integrity, while the glass lining helps protect the steel from the corrosive effects of water and extends the lifespan of the tank. The glass lining is usually applied to the interior surface of the steel tank through a vitreous enamel process, creating a smooth and protective barrier between the water and the steel. This construction ensures that the tank can withstand the pressure and temperature of the hot water while resisting rust and corrosion.

In natural gas systems, a gas flame is utilized having a temperature of approximately 2250° F., and the water coming into the tank ranges near ambient, or approximately 50° F. on average. Even at equilibrium, the water in the tank is kept below boiling so a tremendous thermal gradient exists. The steel in the base of the tank and the bottom of the chimneys is significantly expanded by the heat of the flame playing directly on the steel at the same time, on the other side of the same steel plate, the steel plate and chimneys are chilled and contracted by the water in the tank.

Throughout the appliance's functional life, the same sheet of steel is expanded and contracted at the same time by the extreme temperature gradient. The steel is effectively wrung by trying to go in opposite directions at the same time. The result is extreme stress on the steel. In a few years the steel splits and the water heater is lost, as well as some peripheral damage to floors and furniture in the home.

Another problem is that sparingly soluble salts within the water will precipitate out at the bottom of the tank as a solid layer. At first this layer reduces heat absorption and valuable heated air drifts out the chimney. Later it becomes so thick that it cuts off absorption completely. At this point the steel is heated to the temperature of the flame and is constantly heated to 2250° F. and then cooled, over and over with each cycle. Such temperatures are close to the melting point of steel, and steel does not last long in such extreme conditions. And, when the tank fails there is a flood in the home, so the cost of a replacement water heater also is generally accompanied by the cost of cleanup and other damage.

Some methods and devices are known that incorporate various mechanisms for minimizing damage caused by thermal cycling and salt precipitate. For example:

U.S. Pat. No. 2,718,583 issued in the name of Nolan et al. describes a water-heater tank of reinforced plastic and method and apparatus for making the same. The plastic water heater tank is formed by helically winding subsequently setting-plastic-impregnated glass-fiber roving cords over and around convex tank heads and helically around a cylindrical lining shell connected there between. An electric resistance wire may also be embedded in the tank walls.

U.S. Pat. No. 4,865,014, issued in the name of Nelson, describes a water heater which may be either gas or electric and designed for use in either residential or commercial applications includes a generally cylindrical molded plastic inner water tank and a generally cylindrical molded plastic outer shell which is sized somewhat larger than the outside diameter of the tank and is disposed around the tank so as to define an annular clearance space between the shell and the tank. By means of covers and end members the clearance space between the tank and the shell are sealed closed so that a vacuum can be drawn on this closed clearance space and thereby provide thermal insulation for the inner water tank by means of the vacuum. A related construction includes a double-walled outer shell wherein the two walls are spaced apart from one another so as to define a clearance space there between. This clearance space is sealed closed and a vacuum drawn in order to provide the requisite insulation for the inner water tank which is disposed on the interior of the shell.

And, Canadian Patent No. 2,759,310, issued in the name of Lesage et al., describes a method of constructing an inner glass-lined steel tank. The lower edge of the top dome shell is machined wherein a smooth angulated surface is formed between an outer and an inner surface of the top dome shell to form a smooth angulated surface to eliminate abrupt transition edges. Also, couplings are machined and press-fitted into the tank wall to form smooth surfaces with the inner surface of the tank. When the porcelain enamel is sprayed inside the tank there are no sharp edges which often results in defects due to the fact that the porcelain enamel is not properly adhered thereto. Such defects eventually cause corrosion within the inner tank and greatly reduce the life expectancy thereof as well as the life expectancy of the sacrificial anode connected to the tank and extending therein.

Consequently, a need has been felt for hot water heater design that allows for a means to allow for extended operational life of the device.

SUMMARY OF THE INVENTION

It is thus an object of the present invention to provide an improved hot water heater designed for extended operational life.

It is a feature of the present invention to provide a modular reversible water heater design that allows for changing of hot and cool side components prior to their failure.

The present invention provides a modular water tank design in which the upper and lower pans are made such that they are interchangeable. After several years of continuous use, the top and bottom pans may then be removed, and the water tank inverted, and the pans reattached on the opposite ends of where they were initially installed. Once inverted, the original bottom steel plate is now positioned well away from the hot flame to stop additional thermal cycling. Further, the salt-covered bottom of the hot water heater is now on the top, where the temperature gradient is lesser. The new lower tank pan now has a history of less thermal cycling, and the newly configured tank will now sustain an additional several years of operation before succumbing to failure.

An advantage of the present invention includes extended lifespan, with the modular reversible design significantly extending the operational life of water heaters by reducing thermal stress and addressing salt accumulation.

Further, the present invention minimizing extreme temperature gradients and enhances the efficiency of the water heater, leading to improved heat absorption and reduced energy consumption.

Further still, the invention reduces maintenance costs and the need for premature replacements, resulting in substantial savings for homeowners. And, the longer-lasting water heaters contribute to reduced waste and environmental impact associated with frequent replacements.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Finally, unless a claim element is defined by reciting the word "means" and a function without the recital of any structure, it is not intended that the scope of any claim element be interpreted based on the application of 35 U.S.C. § 112 (f).

Figure 1:
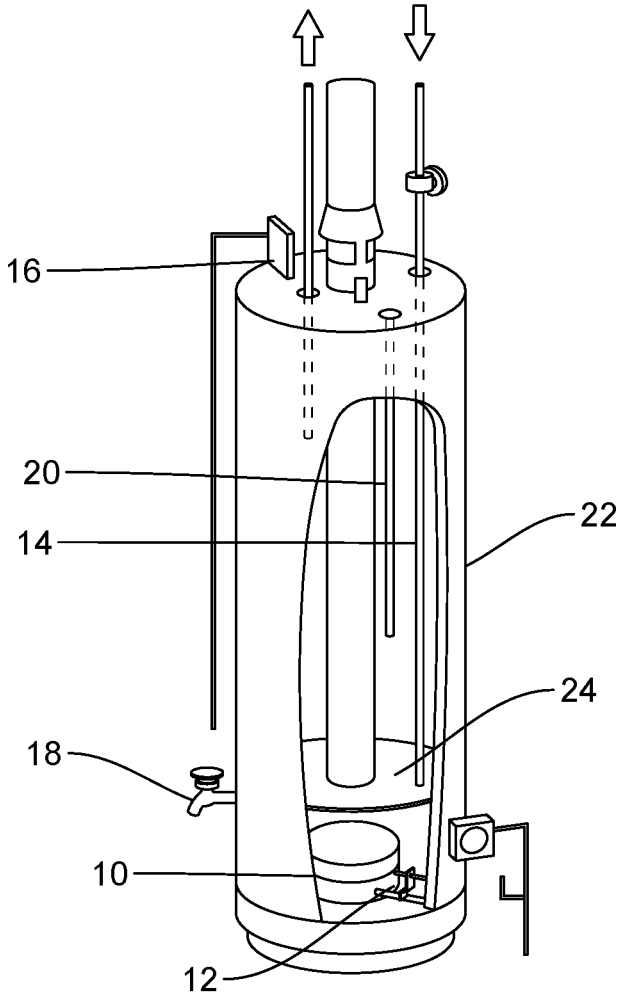
PRIOR ART FIG. 1
FIG. 1 is a schematic diagram of an otherwise conventional gate water heater design according to the PRIOR ART.
Figure 2:
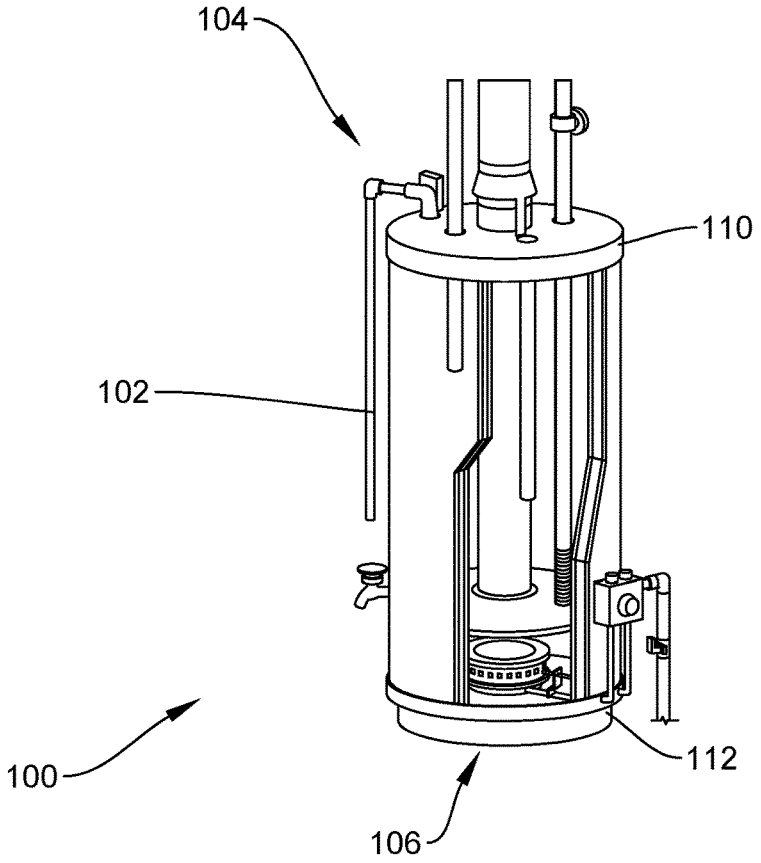
FIG. 2 is a schematic diagram of an improved modular hot water heater design according to the preferred embodiment shown in a first orientation.
Figure 3:
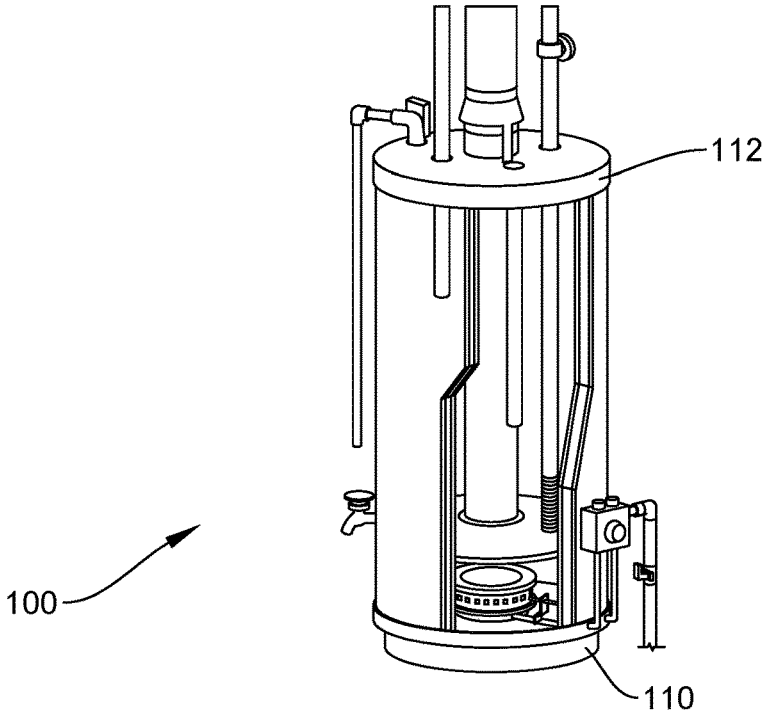
FIG. 3 is a schematic diagram thereof shown in a second orientation.

The best mode for carrying out the invention is presented in terms of its preferred embodiment, herein depicted within the FIG. 2 through FIG. 3.

1. Detailed Description of the Figures

Referring now to the drawings, wherein like reference numerals indicate the same parts throughout the several views, an improved modular reversible water heater tank, generally noted as 100, is provided according the preferred embodiment of the present invention. The tank 100 comprises a cylindrical or rectangular sidewall 102 for containing a working volume of water. The sidewall has an upper end 104 opposite a lower end 106.

The upper end 104 is equipped with an upper pan 110. The lower end 106 is equipped with a lower pan 112. The pans

110, 112 are specifically adapted to be removed and reattached on the opposite ends of the tank 100 after a period of continuous use.

The tank sidewall 102 may consists of a steel outer jacket that encloses a pressure-tested water storage tank. This inner tank may be made of high-quality steel with a vitreous glass or plastic layer bonded to the inside surface to prevent rusting. An exhaust flue is directed through the upper pan 110 for discharge of exhaust gases to an exhaust vent. In most designs. The tank 102 may also generally formed of an inner storage tank and the outer tank jacket with a layer of insulation therebetween designed to reduce heat loss (not shown). Both the upper pan 110 and the lower pan 112 may also be made of steel or of steel with a glass or plastic lining or a glass-lined steel tank.

The pans 110, 112 are further affixed to and seal the tank sidewall 102 such as to ensure that the tank can withstand the pressure and temperature of the hot water while resisting rust and corrosion.

2. Operation of the Preferred Embodiment

In operation, a reconfiguration of the modular tank design effectively changes the orientation of the tank, minimizing the impact of extreme temperature gradients and thermal stress. As shown in conjunction with FIG. 3, after a number of years in operation, the placement of the pans 110, 112 are reversed in their location on the tank, ensuring that the original lower pan 112, which is susceptible to extreme thermal cycling, is relocated to the upper end 104 and away from the direct heat source. Similarly the original upper pan 110, having been exposed to reduced stress on the material, is positioned at the lower end 106 and thereby extending the tank's operational life.

By repositioning the upper and lower pans, the invention mitigates the simultaneous expansion and contraction of the steel caused by extreme temperature gradients. This reduction in thermal stress significantly prolongs the life of the tank. Further, the modular design also addresses the issue of salt accumulation within the tank. By inverting the tank end enclosing pans, the salt-covered bottom is moved to the top, where temperature gradients are less severe. This prevents salt from interfering with heat absorption and reduces the risk of corrosion.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Provisional Patent Application.

What is claimed is:

1. A modular reversible water heater system comprising:

a cylindrical liquid filled tank with an inner surface and an outer surface, said liquid filled tank having a tank head on a top and a tank base on a bottom and being constructed from a metal material;

an upper cap removably attached over the tank head and a lower heating apparatus enclosure removably attached under the tank base, wherein said upper cap includes a chimney structure configured for conducting products of combustion away from said liquid filled tank and into exhaust pipes, and said lower heating apparatus enclosure accommodates a heat-generating mechanism;

wherein after a predetermined period of use in an original orientation, the liquid filled tank is designed to be physically invertible relative to said upper cap and said lower heating apparatus enclosure, and upon said physical inversion, the upper cap and lower heating apparatus enclosure are reattachable to said liquid filled tank in an inverted orientation relative to the original orientation while maintaining the upper cap over the tank base and the lower heating apparatus enclosure under the tank head, said physical inversion repositioning the tank base away from the heat-generating mechanism and the tank head closer to the heat-generating mechanism, thereby mitigating thermal cycling effects on the metal material and optimizing positioning of accumulated salts.

2. A method for enhancing the longevity of a hot water heater, comprising the steps of:

providing a tank with an inner surface and an outer surface, said tank having a tank head on a top and a tank base on a bottom and being constructed from a metal material;

attaching an upper cap removably attached over the tank head and a lower heating apparatus enclosure removably attached under the tank base, said upper cap configured for conducting products of combustion away from said tank and into exhaust pipes, and said lower heating apparatus enclosure accommodating a heat-generating mechanism;

utilizing said hot water heater tank for a predetermined period of time;

detaching said upper cap and said lower heating apparatus enclosure from said tank;

physically inverting the tank relative to an original orientation such that the tank base is repositioned away from the heat-generating mechanism and the tank head is repositioned closer to the heat-generating mechanism; and reattaching said upper cap to the tank base and said lower heating apparatus enclosure to the tank head such that the upper cap remains over the tank and the lower heating apparatus enclosure remains under the tank after said physical inversion, thereby mitigating the effects of thermal cycling on the metal material and optimizing positioning of accumulated salts.

3. The method of claim 2, further comprising the step of utilizing said upper cap to conduct products of combustion away from said tank and into exhaust pipes.

4. The method of claim 2, further comprising the step of utilizing said lower heating apparatus enclosure to house the heat-generating mechanism, wherein the heat-generating mechanism comprises an electric heating element or a gas burner for generating heat.

* * * * *